United States Patent [19]

Smith, Jr.

[11] Patent Number: 4,726,425

[45] Date of Patent: Feb. 23, 1988

[54] COMBINATION LANDING UNIT AND SEAL ASSEMBLY

[75] Inventor: Sidney K. Smith, Jr., Huntsville, Tex.

[73] Assignee: Hughes Tool Company, Houston, Tex.

[21] Appl. No.: 87,990

[22] Filed: Aug. 17, 1987

Related U.S. Application Data

[63] Continuation of Ser. No. 809,096, Dec. 16, 1985, abandoned.

[51] Int. Cl.[4] ..... E21B 23/02

[52] U.S. Cl. ..... 166/387; 166/208; 166/217; 166/382; 285/140

[58] Field of Search ..... 166/115, 118, 217, 237, 166/208, 377, 382, 386, 387; 285/138, 140

[56] References Cited

U.S. PATENT DOCUMENTS

| | | | |
|---|---|---|---|
| 3,920,075 | 11/1975 | Braddick et al. | 166/290 |
| 3,990,510 | 11/1976 | Decuir | 166/128 |
| 4,083,408 | 4/1978 | Milam | 166/315 |
| 4,248,300 | 2/1981 | Braddick | 166/386 |
| 4,399,873 | 8/1983 | Lindsey, Jr. | 166/382 |
| 4,406,324 | 9/1983 | Baugh | 166/125 |
| 4,411,455 | 10/1983 | Schnatzmeyer | 285/39 |
| 4,479,548 | 10/1984 | Gilbert | 166/123 |
| 4,482,014 | 11/1984 | Allwin | 166/136 |
| 4,497,371 | 2/1985 | Lindsey, Jr. | 166/217 |
| 4,646,842 | 3/1987 | Arnold et al. | 166/382 |

OTHER PUBLICATIONS

Baker Oil and Tools, Inc., Technical Manual, "Models CL-1 and CR-1 Tubing Seal Receptacle Units, 11-1-5-1964, pp. 2-6.

TIW Catalog (1985), pp. 24-26.

*Primary Examiner*—Stephen J. Novosad
*Assistant Examiner*—Terry Lee Melius
*Attorney, Agent, or Firm*—Charles D. Gunter, Jr.

[57] ABSTRACT

A combination landing unit and seal assembly is shown for engaging and sealing within the internal bore of the liner within a well. A special latch mechanism carried on the seal assembly includes an externally threaded latch collet which can be stabbed into the setting sleeve threads which are normally provided in the interior of the liner for use with the running tool which installs the liner in the well bore. An integral seal assembly is carried in the assembly in an upward extension of the landing unit and floats within a tubular extension of the landing unit. A plug can be installed in the landing unit to allow the seal assembly to be retrieved to the well surface without killing the well.

11 Claims, 14 Drawing Figures

COMBINATION LANDING UNIT AND SEAL ASSEMBLY

This application is a continuation of application Ser. No. 809,096, filed 12-16-85 now abandoned.

BACKGROUND OF THE INVENTION

1. Cross Reference to Related Applications

The subject matter of the present application is related to co-pending application "LATCHING PRODUCTION SEAL ASSEMBLY", by Sidney Kenneth Smith, Jr., U.S. Ser. No. 809,356 filed 12/16/85 now U.S. Pat. No. 4,655,290, and assigned to the assignee of the present invention.

2. Field of the Invention

The present invention relates to seal assemblies of the type used to seal within a liner in a well, to connect a tubing string within the liner for the production of well bore fluids and, specifically, to such a seal assembly which includes an integral landing unit for receiving a plug to temporarily close off the well during remedial work.

3. Description of the Prior Art

Oil and gas wells are completed by installing a production casing or "liner" into the hole from the surface and cementing the liner in place. The liner is typically provided with a setting sleeve having an internally threaded region which is engaged by the external threads of a conventional running tool. The running tool is used to lower the liner to the proper depth within the well, and to apply setting force to "hang" the liner from gripping members within the well bore.

After the liner has been hung and cemented in place, the liner is perforated at the producing depth and the oil and/or gas flows from the surrounding earthern formation through the perforations and up the liner to the surface, usually through production tubing.

In the past, a section of the liner interior, or a connection thereto, was typically provided with a highly machined "polished bore" for receiving the lower extent of the production tubing string. The tubing string was provided with external seals which formed a sliding seal within the polished bore, thereby allowing the tubing string to have a "stroke" to compensate for temperature and pressure variations in the well.

It was also desirable to provide a retrievable landing unit or "landing nipple", with an internal profile, below the seal region so that a plug could be seated in the profile to temporarily close off production without killing the well. In this way, the production string could be pulled to the well surface and remedial work could be performed on the well. Once the work was complete, the production string could be reinstalled and the plug removed. The landing nipple itself could be retrieved to the well surface to provide a full bore through the liner, if desired.

The use of a landing nipple below the sliding seal generally required a two trip installation procedure. One trip into the well was required to install the landing nipple. Another trip was then required to install the production tubing string.

The present invention has as its object the provision of a combination retrievable landing unit and production seal assembly which is run and installed in the liner in a one trip operation.

Another object of the invention is the provision of a landing unit and seal assembly which can be latched into the internally threaded surface of the liner setting sleeve. These are the same threads which are engaged by the liner running tool during the installation of the liner within the well bore and prior to retrieving the running tool to the well surface.

Another object of the invention is the provision of a landing unit and seal assembly with a backup release mechanism which allows a straight pull release as a safety measure in addition to a standard release effected by right hand rotation of the tubing string from the well surface.

SUMMARY OF THE INVENTION

The combination landing unit and seal assembly of the invention is used to seal a tubing string within the internal bore of a liner, the liner being of the type which includes a liner setting sleeve with internal threads which are engaged by mating threads of a liner running tool during the installation of the liner within the well bore. The seal assembly includes a tubular landing unit having an internal profile for receiving a plug, an upward tubular extension with a polished internal bore, and a latch collet carried about the exterior of the landing unit between an upper shoulder and a lower shoulder. The latch collet has a collet body and a plurality of externally threaded collet fingers extending downwardly therefrom which are adapted to engage the setting sleeve threads to secure the combination landing unit and seal assembly within the liner.

An external seal region is located on the exterior of the tubular landing unit for sealing within the bore of the liner below the liner setting sleeve threads. A floating seal assembly is initially received within the polished internal bore of the upward extension of the landing unit. The floating seal assembly has upper connecting means for connection in a well tubing string extending to the well surface and has an external running latch for initially fixing the floating seal assembly within the internal bore of the upward extension.

Additional objects, features and advantages will be apparent in the written description which follows.

DETAILED DESCRIPTION OF THE INVENTION

Figure 1A:
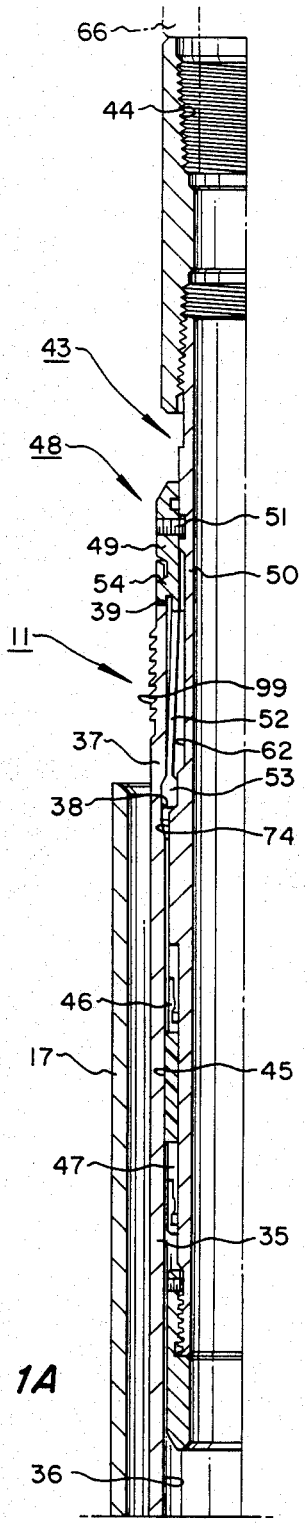
FIG. 1A is a side, partial cross-sectional view of the upper portion of the combination landing unit and seal assembly of the invention engaged within a liner in a well bore.
Figure 1B:
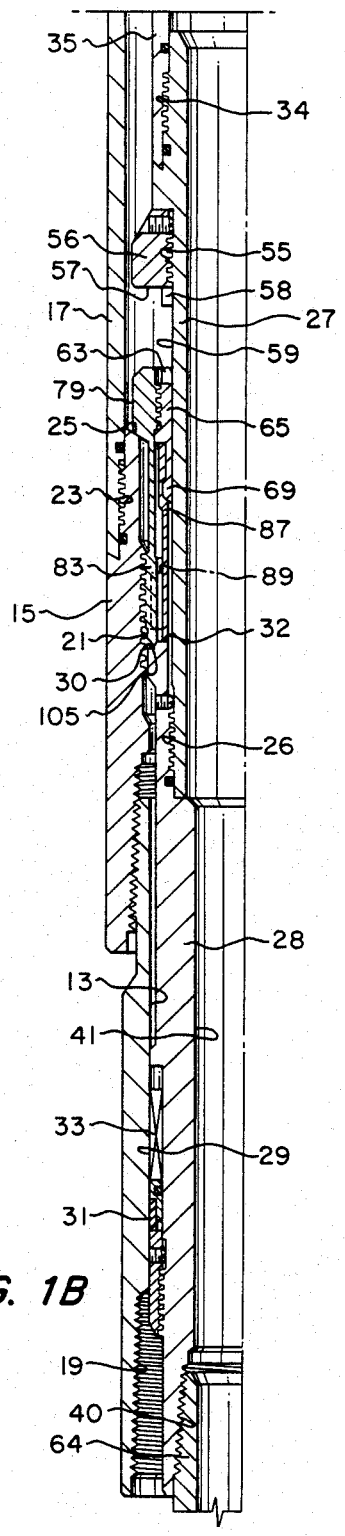
FIG. 1B is a downward continuation of the combination landing unit and seal assembly of FIG. 1A.

FIGS. 1A–1B show a combination landing unit and seal assembly of the invention designated generally as 11. The assembly 11 is used for sealing within the internal bore 13 (FIG. 1B) of a liner within a well. The liner is a cylindrical conduit of conventional design including a setting sleeve 15 and an upwardly extending setting sleeve extension 17. The liner has an internally threaded surface 19 for engaging the pin member (not shown) of a mating liner string extending downwardly into the well. The setting sleeve 15 and setting sleeve extension 17 are joined at a threaded connection 23 to form an internal shoulder 25.

The liner setting sleeve 15 has an internally threaded surface 21 (see FIG. 9B) which is adapted to be engaged by the mating threads of a conventional liner running tool during the installation of the liner within the well bore, and prior to retrieving the running tool to the well surface. Liner running and setting tools of the type under discussion are known to those skilled in the art and do not form a part of the present invention. Such a liner running tool is shown, for instance, in U.S. Pat. No. 4,441,560, issued Apr. 10, 1984, to John L. Baugh, et al.

As shown in FIGS. 1A–1B, the combination landing unit and seal assembly includes a tubular landing unit made up of an upper portion 27 and lower portion 28, connected at threaded junction 26. The lower portion 28 has an external seal means 29 carried thereon for sealingly engaging the internal bore 13 of the liner. The seal means 29 can include a seal ring 31 and packing 33, for sealing against the internal bore 13.

The upper portion 27 of the tubular landing unit has an externally threaded upper extent 34 which matingly engages the internally threaded surface of an upward tubular extension 35. Tubular extension 35 preferably is provided with a polished internal bore 36 and may extend for twenty feet or more in length. Extension 35 also includes an upper extent 37 having an internal recess or groove 38 and a serrated outer region 99. Upper extent 37 also has a plurality of end slots (slot 39 shown in FIG. 1A) spaced in equidistant fashion about the lip of the tubular extension and extending in the direction of the longitudinal axis of the tubular extension.

The lower portion 28 of the tubular landing unit has an internally threaded surface 40 for matingly engaging a conventional plug catcher sub (shown as 64 in FIG. 1B). Plug catcher subs are known to those skilled in the art. A suitable catcher sub can be commercially obtained from Hughes Tool Company as the "Brown Type Catcher Sub," shown in the 1984–85 Hughs Tool Company Consolidated Catalogue, page 21. Usually the plug catcher would be designed to receive a plug lowered into the bore 41 on a wire line in the manner known to those skilled in the art.

A floating seal assembly 43 is initially received within the polished internal bore 36 of the upward extension 35 of the landing unit. The floating seal assembly 43 has upper connecting means 44 for connection in a well tubing string (shown in dotted lines as 66 in FIG. 1A) extending to the well surface. Seal assembly 43 can include a circumferential elastomeric seal region 45 located between retainer rings 46,47 for forming a sliding seal with the bore 36. Although the upward tubular extension 35 and the seal region 45 are shown shortened for simplicity, it should be understood that these members could extend for a much greater length. As will be explained, the floating seal assembly 43 can then be allowed a "stroke" within the bore 36 which can be fifteen to twenty feet or more in length.

Figure 5:
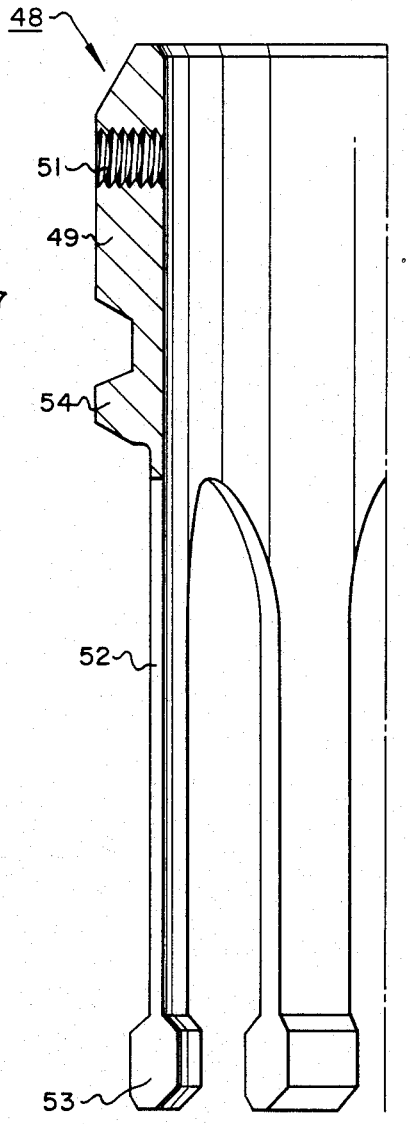
FIG. 5 is a side, partial cross-sectional view of the running-in collet of the assembly of FIG. 1A.

The floating seal assembly 43 is initially fixed in position within the bore 36 by means of an external running latch 48. As shown in FIG. 5, the latch 48 is a collet-like member having a ring shaped collet body 49 which is initially pinned to the cylindrical body 50 of the seal assembly by one or more shear pins 51. A plurality of collet fingers 52 extend downwardly from the collet body 49 and terminate in collet lugs 53. Lugs 53 are received in the groove 38 in the upward tubular extension 35 when the floating seal assembly is in the position shown to thereby support the tubular extension 35 and landing unit from the well tubing string 66. The running collet is assembled on the exterior surface 74 of the seal assembly 43 with the collet fingers 52 being forceably extended outwardly by the exterior surface 74 to retain the lugs 53 in the groove 38.

The collet body 49 is also provided with a plurality of cogs 54 spaced equidistantly about the circumference of the collet body which are adapted to be received within the mating slots 39 (FIG. 1A) provided in the upper extent 37 of the tubular extension 35. In the position shown, torque transmitted to the floating seal assembly 43 from the tubing string 66 is transmitted through the collet cogs 54 to the tubular extension 35.

As shown in FIG. 1B, the upper portion 27 of the landing unit has an externally threaded surface 55 for engaging an external ring 56. The lower surface of ring 56 forms an upper shoulder 57 with respect to the exterior surface 59 of upper portion 27. Upper portion 27 of the landing unit also includes a camming cog 58 which protrudes from the external surface 59. Preferably, two cogs are arranged at opposite circumferential locations about the external surface 59.

Figure 2:
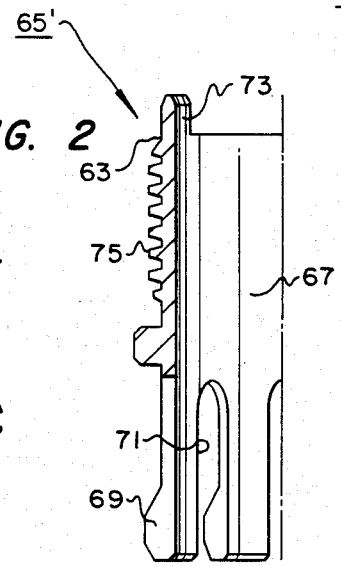
FIG. 2 is a side, partial cross-sectional view of the clutch collet of the assembly of FIG. 1B.

As best seen in FIGS. 1B and 2, the cogs 58 are adapted to engage the upper camming surface 63 of a clutch collet 65 which is carried about the upper portion 27 of the landing unit. The clutch collet 65 is shown in detail in FIG. 2. The clutch collet includes a collet body 67 and a plurality of downwardly extending collet fingers 69 which are separated by longitudinal openings 71. The upper camming surface 63 includes a plurality of upwardly extending projections 73 which matingly engage and mesh in the spaces provided between the camming cogs 58 so that torque can be transmitted between the clutch collet 65 and landing unit portion 27.

Figure 9A:
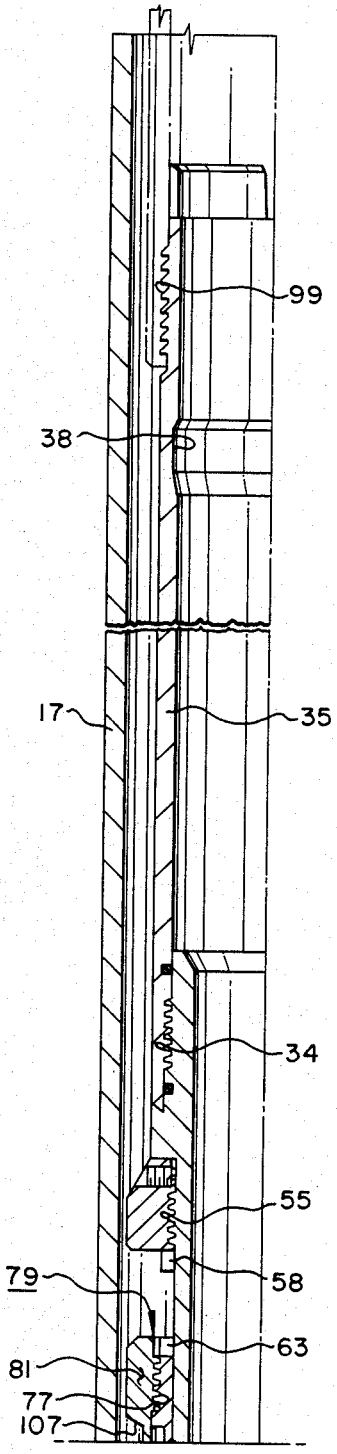
FIG. 9A is a side, partial cross-sectional view of the upper portion of the assembly of the invention showing the retrieval of the assembly to the well surface.
Figure 9B:
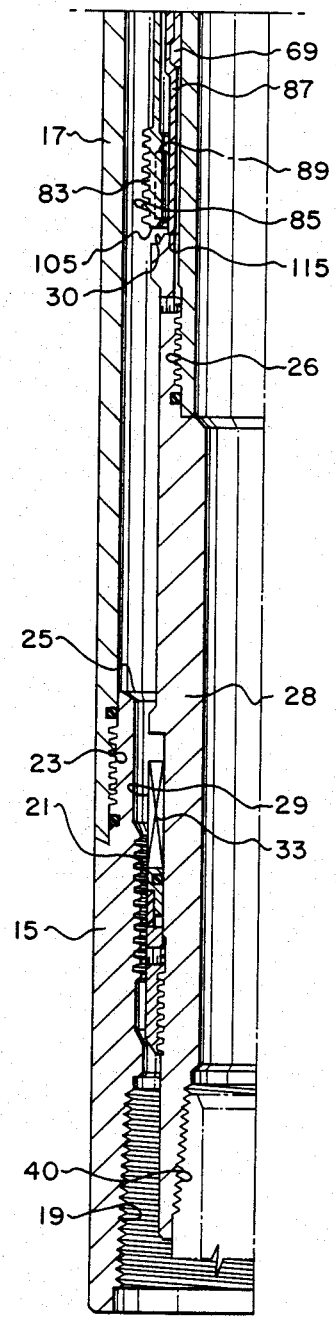
FIG. 9B is a downward continuation of the device of FIG. 9A.

The collet body 67 has an externally threaded surface 75 which is adapted to engage a mating internally threaded surface 77 of a latch collet 79. As best seen in FIGS. 9A and 9B, the latch collet 79 includes a ring-shaped collet body 81 and a plurality of externally threaded collet fingers 83 extending downwardly therefrom. The externally threaded surfaces 85 are adapted to engage the liner setting sleeve threads 21 when the latch collet 81 is stabbed into the setting sleeve 15, as shown in FIG. 1B.

A clutch sleeve 87 depends downwardly from the clutch collet 65 and is located between the landing unit upper portion 27 and the latch collet fingers 83, as shown in FIG. 1B. The clutch collet fingers 69 are engaged within an internal recess or groove (66 in FIG. 8A) formed in an upper interior surface of the clutch sleeve 87. The clutch sleeve 87 also includes a plurality of radially extending cogs (shown in dotted lines as 89) which are received within the longitudinal openings which exist between the collet fingers 83 of the latch collet 79. In this way, torque can be transmitted from the clutch sleeve 87 to the latch collet 79 to unthread the latch collet 79 from the setting sleeve threads 21, as will be explained.

Figure 3:
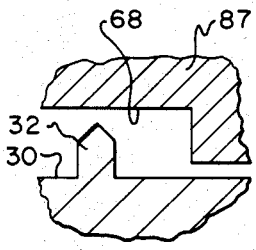
FIG. 3 is a simplified, schematic view of the cam surfaces of the clutch sleeve and lower external shoulder of the assembly of FIG. 1B, showing the operation thereof.
Figure 4:
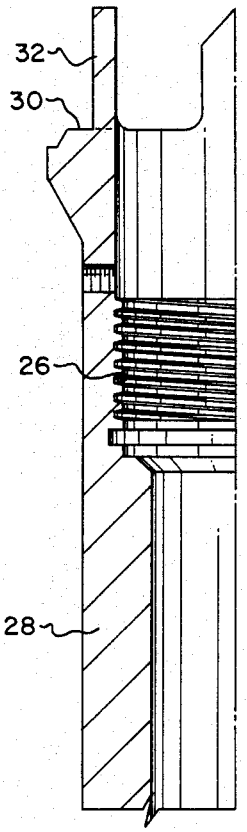
FIG. 4 is a side, partial cross-sectional view of the lower abutment and cam means of the latch mechanism of the invention.

The clutch sleeve 87 is provided with end slots at the lower extent thereof which are engaged by upwardly extending projections 32 extending from the lower shoulder 30 formed on the exterior of the lower portion 28, adjacent the threaded connection 26 (see FIG. 4). The projections 32 act as cam means for engaging mating slots 68 provided in the lower end of the clutch sleeve 87, in the same way that the projections 73 of the clutch collet 67 engage the cogs 58 of the upper portion 27 of the landing unit. This is illustrated schematically in FIG. 3. In the position shown in FIGS. 1A and 1B, rotation of the well tubing string 66, seal assembly 43, and landing unit lower portion 28 results in torque being transmitted through the cam surfaces 32 to the clutch sleeve 87, and from the clutch sleeve cogs 89 to the latch collet 79.

The operation of the combination landing unit and seal assembly of the invention will now be described. The liner is first run into position in the well bore by means of a running tool, such as that shown in U.S. Pat. No. 4,441,560, which engages the threaded surface 21 of the liner setting sleeve. The liner is hung at the proper depth by appropriate manipulation of the running tool to actuate external gripping means (not shown) on the liner hanger. The liner is then typically cemented in place, and the running tool is retrieved to the well surface. All of these steps are conventional practice and are known to those skilled in the art.

When it is desired to produce from the well, or if it is necesssary to perform workover operations, the combination landing unit and seal assembly is run into position. As the latch collet fingers 83 contact the internally threaded surface 21 of the liner setting sleeve 15, the externally threaded fingers 83 ratchet into engagement with the setting sleeve threads 21. This is possible because the lower shoulder or abutment 30 is moved axially downwardly from beneath the lower tapered surfaces 105 of the latch collet fingers during the running-in operation.

Downward axial movement of the latch collet fingers 83 allows the external taper 107 (FIG. 9A) of the latch collet body 81 to contact the shoulder 25 provided by the liner setting sleeve (FIG. 1A). When this occurs, further downward travel of the latch collet 79 is prevented. As shown in FIG. 1B, any pressure fluctuation tending to move the seal 29, and hence the landing unit 28, upwardly will tend to push the lower shoulder 30 into tighter engagement with the latch collet fingers 83. This action retains the collet fingers in the liner threads 21 and latches the assembly into place.

Figure 6A:
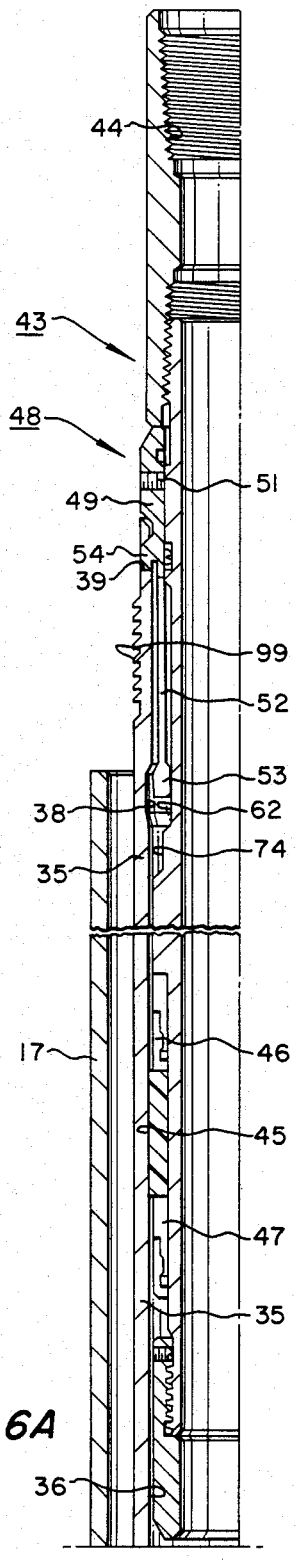
FIG. 6A is a side, partial cross-sectional view of the combination landing unit and seal assembly of FIG. 1A after weight has been set down on the tubing string from the well surface.
Figure 6B:
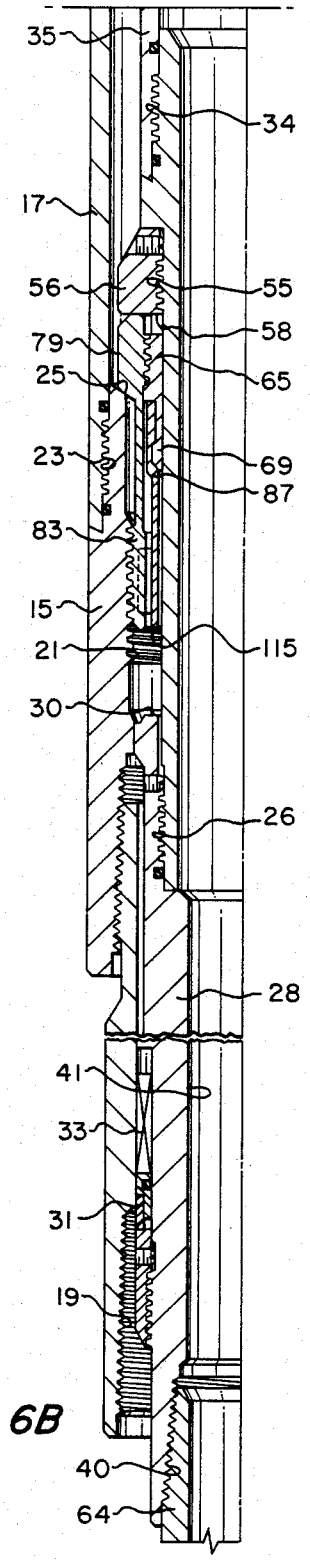
FIG. 6B is a downward continuation of FIG. 6A.

In order to provide a "floating seal" within the bore 36 of the upward tubular extension 35, the operator sets down weight from the well surface on the tubing string and the seal assembly 43. This action, which is shown in FIGS. 6A and 6B, shears the pins 51, thereby allowing the seal assembly 43 to slide downwardly within the bore 36. As the seal assembly moves downwardly, the region of decreased external diameter 62 of the seal assembly 43 underlies the collet fingers 52, which releases the seal assembly 43 and allows the seal assembly to have a "stroke" within the bore 36.

Figure 7A:
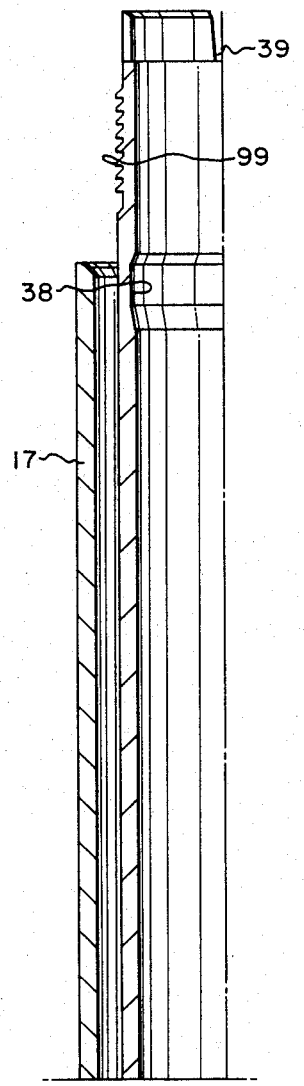
FIG. 7A is a side, partial cross-sectional view of the upper portion of the assembly of FIG. 1A with the floating seal assembly having been retrieved to the well surface.
Figure 7B:
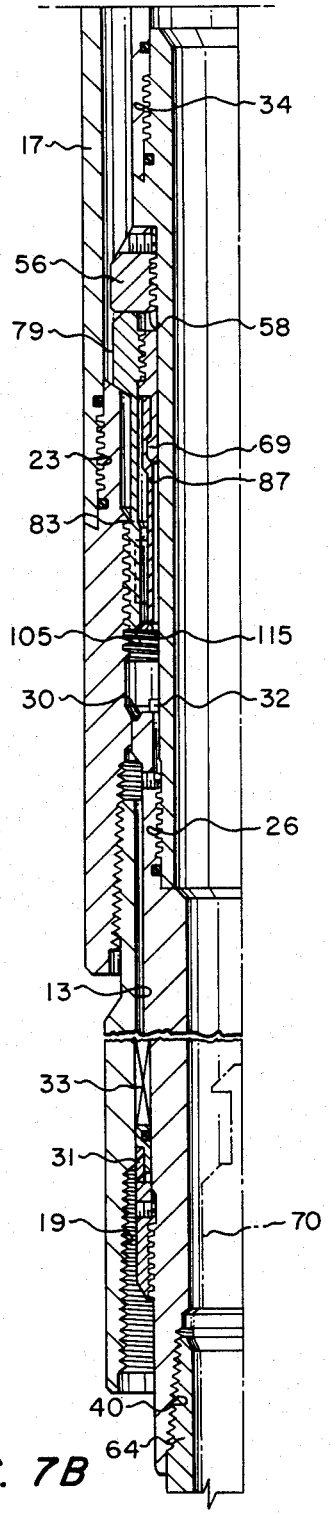
FIG. 7B is a downward continuation of the device of FIG. 7A.

From the position shown in FIGS. 6A and 6B, the seal assembly 43 can be retrieved to the well surface, leaving the landing unit latched within the liner. If it becomes necessary, to perform remedial work on the producing well, or on the seal assembly 43, the well can be temporarily closed off and the seal assembly retrieved to the well surface without "killing" the well. This would usually be accomplished by lowering a plug (shown in dotted lines 70 in FIG. 7B) on a wire line to the plug catcher sub (64 in FIG. 7B) provided on the lower portion 28 of the landing unit. The seal assembly 43 would then be retrieved to the well surface on the well tubing string, leaving the landing unit latched within the liner, as shown in FIG. 7A.

The combination landing unit and seal assembly can be retrieved from the position shown in FIGS. 1A and 1B prior to releasing the seal assembly, if desired. The well tubing string is lifted to engage cam surface 30 with the clutch sleeve 87 and the tubing string leading to the well surface is rotated to the right. This causes torque to be transmitted through the landing unit portion 28, cam means 32, clutch sleeve 87 and cogs 89 to the latch collet 79. The setting sleeve threads 21 are preferably left hand threads so that right hand torque on the tubing string from the well surface unthreads the latch collet fingers, allowing the combination landing unit and seal assembly to be retrieved upwardly from the well bore.

Figure 8A:
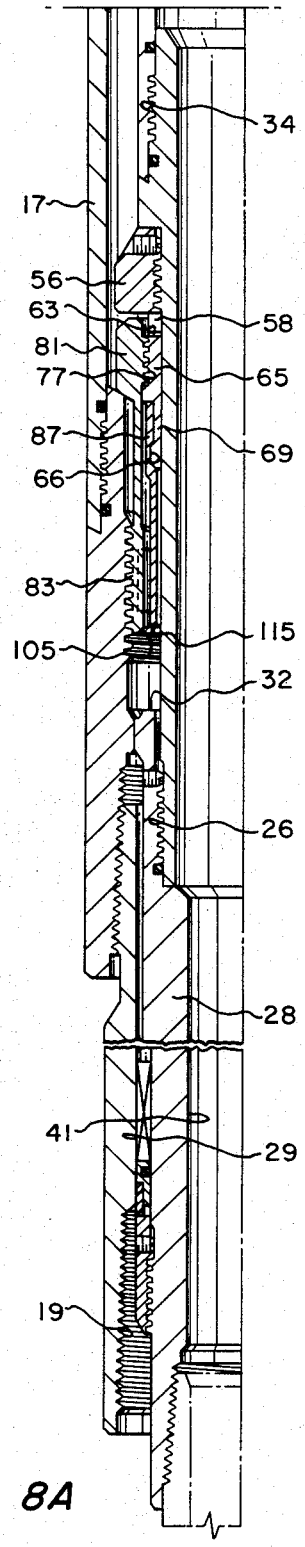
FIG. 8A is a side, partial cross-sectional view similar to FIG. 1B showing the beginning operation of the safety release feature of the latch mechanism.

In the event that the operator encounters difficulty in disengaging the latch mechanism as previously described, an additional safety release is provided. In order to effect the safety release, weight is set down on the tubing string from the well surface causing the upper shoulder 57 and cam 58 to engage the upper camming surface 63 of the clutch collet 65, as shown in FIG. 8A. Torque applied to the tubing string from the well surface now acts through the cams 58,63 so that the clutch collet 65 is rotated and travels approximately ⅜ inch down the threaded surface 77 of the latch collet body 81. Since the collet fingers 69 of the clutch collet 65 are received within a circumferential groove 66 (FIG. 8A) provided in the upper end of the clutch sleeve 87, the rotational movement of the clutch collet 65 is translated into downward axial travel of the clutch sleeve 87.

Figure 8B:
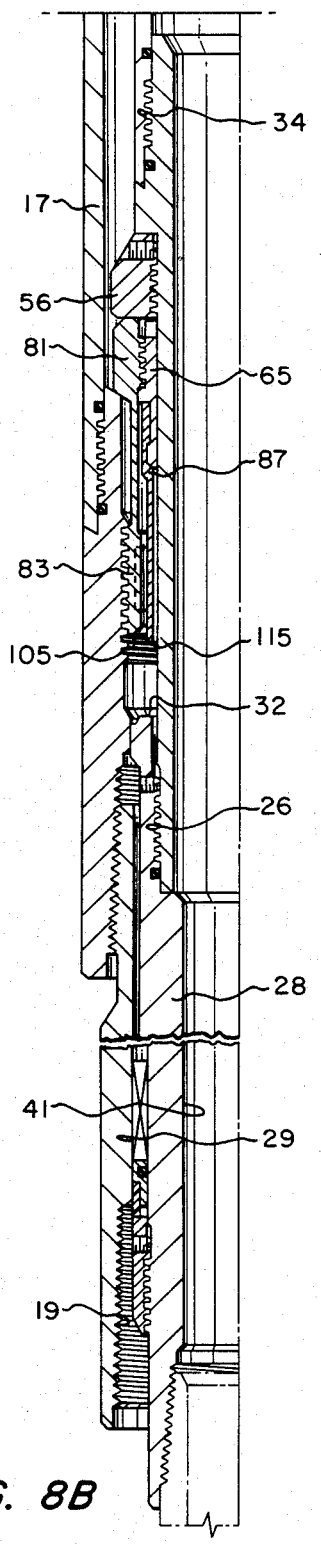
FIG. 8B is a side, partial cross-sectional view similar to FIG. 8A, showing the continuation of the safety release operation.

As shown in FIG. 8A, the lower end 115 of the clutch sleeve 87 does not normally extend past the tapered surfaces 105 of the latch collet fingers 83. Downward axial travel of the clutch sleeve 87 causes the lower end 115 of the clutch sleeve to extend past the collet fingers 83 and prevents the lower shoulder 30 from contacting the collet fingers (see FIG. 8B). This action allows the collet fingers to spring radially inwardly to release the latch mechanism as the latch mechanism and seal assembly are pulled upwardly from the well bore. As shown in FIGS. 9A and 9B, the position of the clutch sleeve 87 prevents the lower shoulder 30 from reengaging the latch collet fingers 83 as the latch collet is being pulled from the liner setting sleeve threads 21.

In order to retrieve the landing unit from the position shown in FIGS. 6A and 6B (with pins 51 sheared), it is necessary to reengage the upward tubular extension 35 with a suitable retrieving tool. Such a tool can be provided, for instance, to engage the outer serrated surface 99 or the inner groove 38 of the extension 35. The retrieving tool indicated in dotted lines in FIG. 9A is shown engaging the outer serrated surface 99. Once the upward extension has been reengaged, torque can again be supplied through the well tubing string and through the landing unit to unthread the latch collet 79 or to actuate the safety release, as has been described.

An invention has been provided with several advantages. The combination landing unit and seal assembly can be installed within a liner in a well bore in a one trip operation. By setting weight down on the well tubing string, the seal assembly can be disengaged and allowed to float within the polished bore of the assembly. The well can be closed off by landing a plug in a receptacle provided on the landing unit. The production seal assembly can then be retrieved to the well surface without the necessity of killing the well or the necessity of using heavy weight fluids to close off production. The production string can then be reinserted in the polished bore of the assembly and the plug can be retrieved to return the well to production.

The assembly of the invention uses a unique latch mechanism which allows the device to be latched into the running tool threads of the liner setting sleeve. As a result, a specially machined sub with a circumferential groove for receiving radially moving dogs is not needed. The stab-in operation of the latch collet is more reliable than radially moving dogs. The seal assembly is normally released by picking up on the tubing string which engages mating camming surfaces on the landing unit and clutch sleeve, allowing rotational torque to be transmitted through the landing unit to the latch collet for unthreading the latch collet. If for some reason rotation cannot be achieved through the latch collet, a safety release is provided. After rotating the clutch collet only ⅜ inch, the safety release allows the device to be retrieved to the well surface by a straight pull on the tubing string.

While the invention has been shown in only one of its forms, it is not thus limited but is susceptible to various changes and modifications without departing from the spirit thereof.

I claim:

1. A combination landing unit and seal assembly which can be latched within the internal bore of a liner within a well, the liner being of the type which includes a liner setting sleeve with internal threads which are engaged by mating threads of a liner running tool during the installation of the liner within the well bore, comprising:

a tubular landing unit having an internal profile for receiving a plug, an upward tubular extension with a polished internal bore, and having a latch collet carried about the exterior thereof between an upper shoulder and a lower shoulder, the latch collet having a collet body and a plurality of externally threaded collet fingers extending downwardly therefrom which are adapted to engage the setting sleeve threads to secure the combination landing unit and seal assembly within the liner;

an external seal region located on the exterior of the tubular landing unit for sealing within the bore of the liner below the liner setting sleeve threads;

a floating seal assembly initially received within the polished internal bore of the upward extension, the floating seal assembly having upper connecting means for connection in a well tubing string extending to the well surface and having an external running latch for initially fixing the floating seal assembly within internal bore of the upward extension, the landing unit with its internal profile, upper tubular extension and floating seal assembly being initially supported from the well tubing string at the well surface by the upper connecting means on the floating seal assembly whereby the combination landing unit and seal assembly can be installed within the liner in a single trip operation; and wherein the external running latch includes a running collet having a collet body and a plurality of downwardly extending collet fingers and wherein the upward extension of the landing unit is provided with an internal recess for receiving the collet fingers, the running collet being assembled on the exterior of the floating seal assembly with the collet fingers being forceably extended outwardly by the assembly exterior to retain the fingers within the recess.

2. A combination landing unit and seal assembly which can be latched within the internal bore of a liner within a well, the liner being of the type which includes a liner setting sleeve with internal threads which are engaged by mating threads of a liner running tool during the installation of the liner within the well bore, comprising:

a tubular landing unit having an internal profile for receiving a plug, an upward tubular extension with a polished internal bore, and having a latch collet carried about the exterior thereof between an upper shoulder and a lower shoulder, the latch collet having a collet body and a plurality of externally threaded collet fingers extending downwardly therefrom which are adapted to engage the setting sleeve threads to secure the combination landing unit and seal assembly within the liner;

an external seal region located on the exterior of the tubular landing unit for sealing within the bore of the liner below the liner setting sleeve threads;

a floating seal assembly initially received within the polished internal bore of the upward extension, the floating seal assembly having upper connecting means for connection in a well tubing string extending to the well surface and having an external running latch for initially fixing the floating seal assembly within internal bore of the upward extension;

wherein the floating seal assembly is a generally cylindrical conduit having an external seal region proximate the lowermost extent thereof and having a region of reduced external diameter above the seal region; and wherein the external running latch includes a running collet having a collet body and a plurality of downwardly extending collet fingers and wherein the upward extension of the landing unit is provided with an internal recess for receiving the collet fingers, the running collet being assembled on the exterior of the floating seal assembly with the collet fingers being forceably extended outwardly by the assembly exterior to retain the fingers within the recess.

3. The combination landing unit and seal assembly of claim 2, further comprising:

shear means for initially fixing the running collet on the exterior of the floating seal assembly in the running position, axial movement of the floating seal assembly from the well surface serving to sever the shear means and move the region of reduced external diameter of the floating seal assembly beneath the running collet fingers to collapse the collet fingers and move the collet to a release position, thereby allowing the floating seal assembly to be retrieved to the well surface.

4. The combination landing unit and seal assembly of claim 3, wherein the running collet body is provided with external lugs adapted to be received within mating lug recesses provided in the upper end of the upward extension for transmitting torque between the floating seal assembly and the upward extension when the running collet is fixed in the running position.

5. A combination landing unit and seal assembly which can be latched within the internal bore of a liner within a well, the liner being of the type which includes a liner setting sleeve with internal threads which are engaged by mating threads of a liner running tool during the installation of the liner within the well bore, comprising:

a tubular landing unit having an internal profile for receiving a plug, an upward tubular extension with a polished internal bore, and having a latch collet carried about the exterior thereof between an upper shoulder and a lower shoulder, the latch collet having a collet body and a plurality of externally threaded collet fingers extending downwardly therefrom which are adapted to engage the setting sleeve threads to secure the combination landing unit and seal assembly within the liner;

a clutch sleeve located between the mandrel and the latch collet, the clutch sleeve having a plurality of radially extending cogs which are adapted to be received between the fingers of the latch collet for transmitting torque between the clutch sleeve and the latch collet;

an external seal region located on the exterior of the tubular landing unit for sealing within the bore of the liner below the liner setting sleeve threads; and a floating seal assembly initially received within the polished internal bore of the upward extension, the floating seal assembly having upper connecting means for connection in a well tubing string extending to the well surface and having an external running latch for initially fixing the floating seal assembly within internal bore of the upward extension.

6. A combination landing unit and seal assembly which can be latched within the internal bore of a liner within a well, the liner being of the type which includes a liner setting sleeve with internal threads which are engaged by mating threads of a liner running tool during the installation of the liner within the well bore, comprising:

a tubular landing unit having an internal profile for receiving a plug, an upward tubular extension with a polished internal bore, and having a latch collet carried about the exterior thereof between an upper shoulder and a lower shoulder, the latch collet having a collet body and a plurality of externally threaded collet fingers extending downwardly therefrom which are adapted to engage the setting sleeve threads to secure the combination landing unit and seal assembly within the liner;

a clutch sleeve located between the mandrel and the latch collet, the clutch sleeve having a plurality of radially extending cogs which are adapted to be received between the fingers of the latch collet for transmitting torque between the clutch sleeve and the latch collet;

an external seal region located on the exterior of the tubular landing unit for sealing within the bore of the liner below the liner setting sleeve threads;

a floating seal assembly initially received within the polished internal bore of the upward extension, the floating seal assembly having upper connecting means for connection in a well tubing string extending to the well surface and having an external running latch for initially fixing the floating seal assembly within the internal bore of the upward extension, and wherein the lower shoulder is provided with cam means for engaging the clutch sleeve when the tubing string is lifted from the well surface for transmitting torque from the lower shoulder to the clutch sleeve and from the clutch sleeve to the latch collet for unthreading the latch collet from the liner.

7. The combination landing unit and seal assembly of claim 6, further comprising:

a clutch collet having a collet body with an externally threaded surface adapted to engage a mating internally threaded surface of the latch collet body, the clutch collet having a plurality of downwardly extending collet fingers which are received within a recess formed in an upper interior surface of the clutch sleeve; and wherein the clutch collet body is provided with cam means at the end thereof opposite the collet fingers, the cam means being engageable with a mating cam formed by the upper shoulder when weight is set down on the tubing string from the well surface and thereby rotation of the tubing string results in downward travel of the clutch collet threads relative to the latch collet threads and, in turn, downward axial travel of the clutch sleeve.

8. The combination landing unit and seal assembly of claim 7, wherein the lower shoulder normally contacts the latch collet fingers when the tubing string is lifted to prevent inward radial movement of the latch collet fingers, and wherein the downward axial travel of the clutch sleeve caused by rotation of the clutch collet moves the lower shoulder from beneath the latch collet fingers to allow inward radial movement of the latch collet fingers and retrieval of the landing unit to the well surface.

9. A method of engaging a combination landing unit and seal assembly within the internal bore of a liner within a well, the liner being of the type which includes a liner setting sleeve with internal threads which are engaged by mating threads of a liner running tool during the installation of the liner within the well bore, comprising the steps of:

providing a tubular landing unit having an internal profile for receiving a plug, an upward tubular extension with an internal bore, and with an external latch including an externally threaded member which is adapted to engage the setting sleeve threads to secure the landing unit within the liner, and an external seal region for sealingly engaging the interior of the liner;

initially fixing a floating seal assembly within the internal bore of the landing unit upward extension at the well surface, prior to running into the well bore, the floating seal assembly being provided with upper connecting means for connection in a tubing string extending to the well surface, the landing unit with its internal profile, upper tubular extension and floating seal assembly being initially supported from the well tubing string at the well surface by the upper connecting means on the floating seal assembly;

engaging the landing unit within the internal bore of the liner by running the landing unit into the bore of the liner on a tubing string and engaging the externally threaded latch member with the setting sleeve threads; and moving the tubing string axially from the well surface to free the floating seal assembly.

10. The method of claim 9, further comprising the steps of:

running a plug through the interior of the tubing string, through the floating seal assembly and into the landing unit profile to shut off the flow of well fluid from beneath the plug; and retrieving the floating seal assembly to the well surface on the tubing sting.

11. The method of claim 10, further comprising the steps of:

performing remedial operations upon the well above the landing unit;

reinserting the floating seal unit into the internal bore of the landing unit upward extension; and removing the plug from the landing unit to again allow the flow of well fluids to the well surface.

* * * * *